US009715988B2

(12) United States Patent
Neilson

(10) Patent No.: US 9,715,988 B2
(45) Date of Patent: Jul. 25, 2017

(54) GYROTRON WHISPERING GALLERY MODE COUPLER WITH A MODE CONVERSION REFLECTOR FOR EXCITING A CIRCULAR SYMMETRIC UNIFORM PHASE RF BEAM IN A CORRUGATED WAVEGUIDE

(71) Applicant: Calabazas Creek Research, Inc., Foster City, CA (US)

(72) Inventor: Jeffrey M. Neilson, Redwood City, CA (US)

(73) Assignee: CALABAZAS CREEK RESEARCH, INC., San Mateo, CA (US)

( * ) Notice: Subject to any disclaimer, the term of this patent is extended or adjusted under 35 U.S.C. 154(b) by 0 days.

(21) Appl. No.: 14/624,245

(22) Filed: Feb. 17, 2015

(65) Prior Publication Data

US 2017/0005386 A1 Jan. 5, 2017

Related U.S. Application Data

(63) Continuation-in-part of application No. 13/016,995, filed on Jan. 29, 2011, now Pat. No. 8,963,424.

(51) Int. Cl.

| | |
|---|---|
| ***H01J 23/40*** | (2006.01) |
| ***H01P 1/16*** | (2006.01) |
| ***H01J 25/02*** | (2006.01) |
| ***H01P 5/02*** | (2006.01) |

(52) U.S. Cl.

CPC ..... *H01J 23/40* (2013.01); *H01J 25/025* (2013.01); *H01P 1/16* (2013.01); *H01P 5/024* (2013.01)

(58) Field of Classification Search

CPC . H01J 23/36; H01J 23/40; H01J 25/02; H01P 1/16

USPC ..... 333/21 R; 315/4, 5, 5.24, 5.29, 5.31; 331/79, 80

See application file for complete search history.

(56) References Cited

U.S. PATENT DOCUMENTS

| | | | | |
|---|---|---|---|---|
| 5,015,914 A | | 5/1991 | Ives et al. | |
| 5,030,929 A | | 7/1991 | Moeller | |
| 5,115,482 A | * | 5/1992 | Stallard et al. | G02B 27/09 315/39 |
| 5,266,962 A | | 11/1993 | Mobius | |

(Continued)

OTHER PUBLICATIONS

Terrezan et al, "Continuous-Wave Operation of a Frequency Tunable 460Ghz Second-Harmonic Gyrotron for Enhanced Nuclear Magnetic Resonance," PSFC/JA-10-64, Plasma Science and Fusion Center Massachusetts Institute of Technology, 2010 (2010).

*Primary Examiner* — Benny Lee

(74) *Attorney, Agent, or Firm* — File-EE-Patents.com; Jay A. Chesavage

(57) ABSTRACT

A cylindrical waveguide with a mode converter transforms a whispering gallery mode from a gyrotron cylindrical waveguide with a helical cut launch edge to a quasi-Gaussian beam suitable for conveyance through a corrugated waveguide. This quasi-Gaussian beam is radiated away from the waveguide using a spiral cut launch edge, which is in close proximity to a first mode converting reflector. The first mode converting reflector is coupled to a second mode converting reflector which provides an output free-space HE11 mode wave suitable for direct coupling into a corrugated waveguide. The radiated beam produced at the output of the second mode converting reflector is substantially circular.

19 Claims, 5 Drawing Sheets

(56) References Cited

U.S. PATENT DOCUMENTS

| | | | | |
|---|---|---|---|---|
| 8,963,424 | B1 * | 2/2015 | Neilson | H01J 23/40 315/5 |
| 2002/0021095 | A1 | 2/2002 | Sakamoto et al. | |
| 2005/0147355 | A1 | 7/2005 | Ilchenko | |

* cited by examiner

Prior Art Gyrotron

Section B–B

Section A–A

Gyrotron Launch Coupler

Section E–E

Section D–D

*Figure 4A*
Waveguide
Cross Section
at start of WG
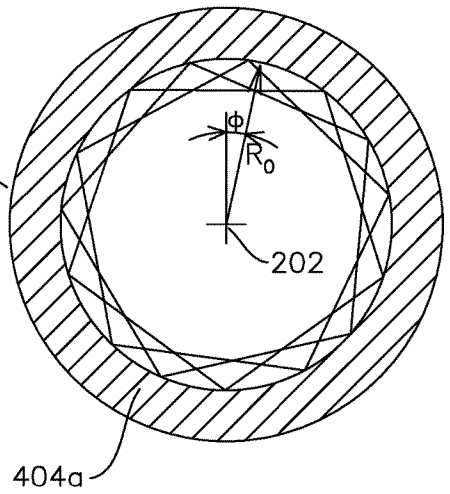
*Figure 4B*
Waveguide
Cross Section
at end of WG
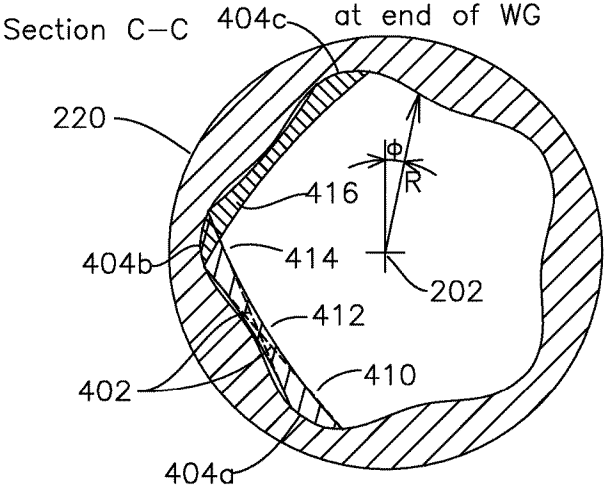
*Figure 4C*
Section C–C
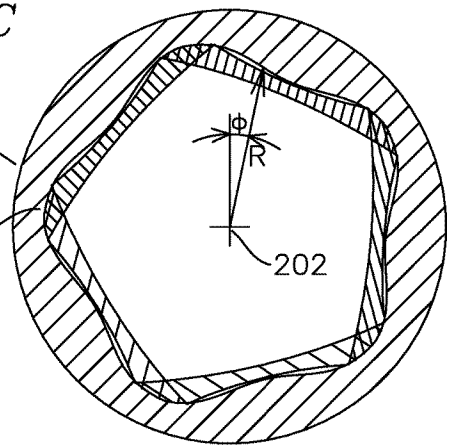
*Figure 5*
QO Mode mixing table
| | | |
|---|---|---|
| (m−2,n+1) 1/36 Pwr | (m+1,n) 1/9 Pwr | (m+4,n−1) 1/36 Pwr |
| (m−3,n+1) 1/9 Pwr | (m,n) 4/9 Pwr | (m+3,n−1) 1/9 Pwr |
| (m−4,n+1) 1/36 Pwr | (m−1,n) 1/9 Pwr | (m+2,n−1) 1/36 Pwr |

GYROTRON WHISPERING GALLERY MODE COUPLER WITH A MODE CONVERSION REFLECTOR FOR EXCITING A CIRCULAR SYMMETRIC UNIFORM PHASE RF BEAM IN A CORRUGATED WAVEGUIDE

The present invention is a continuation-in-part of application Ser. No. 13/016,995 filed Jan. 29, 2011, issued Feb. 24, 2015 as U.S. Pat. No. 8,963,424.

The present invention was developed with the U.S. Department of Energy under grant DE-FG02-05ER84181. The government has certain rights in this invention.

FIELD OF THE INVENTION

The present invention relates to an RF mode converter and coupler for a gyrotron. In particular, the present invention relates to an apparatus and method for coupling the RF power generated in a gyrotron cavity and traveling as a whispering gallery (WG) mode in a cylindrical input waveguide for conversion to the HE11 mode. In one example, the WG mode energy is coupled from a circular input waveguide to a first and second reflector for direct coupling to a corrugated output waveguide.

BACKGROUND OF THE INVENTION

Modern high power gyrotrons produce power in high-order TE modes ($TE_{mn}$ modes with m,n>>1). These modes cannot be efficiently transported as RF (radio frequency) power in a low loss transmission system. In addition, it is advantageous to separate the RF transmission power from that of the spent electron beam within the gyrotron. Both of these considerations are typically addressed using an internal mode converter and a step-cut launcher, which is commonly referred to as a quasi-optical (QO) launcher. The mode converter has small deformations in the input waveguide surface to transform the high-order cavity mode into a set of modes whose combined fields have a Gaussian-like profile. The Gaussian-like beam can then be efficiently launched, focused, and guided by mirrors inside the vacuum envelope of the gyrotron. In this way, the propagating RF power is converted to a mode more suitable for low loss transmission, and the propagating RF beam is separated from the electron beam which carried it. This allows implementation of a depressed collector with large surfaces for thermal dissipation without affecting the quality of the RF beam.

This method has been the primary technique for RF-electron beam separation in high power gyrotrons since the early 1990s. The development of this technique was one of the key technologies enabling the development of mega-watt (MW) level gyrotrons. One drawback of this approach is the internal mirrors must be adjustable for optimum performance to prevent device overheating from internal losses at the high power levels. Additionally, since these large mirrors are external to the gyrotron cavity, the RF power must be coupled out of the gyrotron through a large aperture, which is typically fabricated from expensive materials such as diamond which have the desired low RF power loss and high thermal conductivity required. There are several deficiencies in this technique including internal diffraction losses, electron beam potential depression, and mirror alignment issues.

It is desired to provide a mode converting device which converts high order WG modes travelling helically in a cylindrical input waveguide into HE11 mode for coupling into a corrugated output waveguide inside the gyrotron, thereby greatly reducing the deficiencies of the prior art approaches. In addition, substantial cost savings can be realized by eliminating the need for the two to three adjustable mirrors in the gyrotron and the external mirror optical unit used to couple the output Gaussian beam to the corrugated output waveguide transmission line. A final cost savings would be realized by the large reduction in the required diameter of the diamond material in the output window.

Objects of the Invention

A first object of this invention is a launcher for a gyrotron having an integrated mode converting first reflector coupled to a quasi-optical launcher comprising a cylindrical input waveguide supporting a Whispering Gallery mode (WG mode or WGM) and having a step cut launcher with a launch edge, the first reflector generating an RF beam with an elliptical radiation pattern and coupling the RF beam into a second mode converting reflector generating a free space wave launched from the launch edge of the step-cut launcher, the first reflector generating an RF beam with an elliptical radiation pattern and coupling this RF beam into a second mode converting reflector converting the RF beam from the first reflector into an HE11 mode RF beam for coupling into an output waveguide.

A second object of this invention is a gyrotron having a Whispering Gallery (WG) mode input waveguide with a step-cut launcher, the step-cut launcher having a launch edge and coupling RF energy from the launch edge into a mode converting first reflector on the order of a wavelength from the step-cut launcher and launch edge, the first reflector generating an RF beam having an elliptical radiation pattern and coupling this RF beam into a second mode converting reflector for generating a HE11 mode RF beam for coupling into an output waveguide.

SUMMARY OF THE INVENTION

The present invention is a launch coupler for a gyrotron having helically propagating energy contained by a cylindrical input waveguide having a central axis, the cylindrical input waveguide terminating into a step-cut launcher having a launch edge, wherein the RF energy propagates helically in a whispering gallery (WG) mode down the axis of the cylindrical input waveguide. Propagating RF energy from the launch edge is coupled to a first mode converting reflector which is in close proximity to the launch edge, thereby forming an RF beam, the RF beam thereafter is coupled to a second mode conversion reflector which directs the propagating RF beam onto a path which may be parallel to the central axis of the cylindrical input waveguide, where the first mode conversion reflector and second mode conversion reflector have surfaces selected such that the RF beam which leaves the second mode conversion reflector is substantially coupled into the entrance of a corrugated output waveguide, after which the RF beam propagates in a HE11 mode and may be subject to a variety of standard HE11 waveguide direction changing reflectors. In one example of the invention, the inner surface of the cylindrical input waveguide has depressions in the direction of wave propagation and also depressions perpendicular to the direction of wave propagation for enhanced generation of high order modes which interact with the first mode converting reflector and second mode converting reflector to generate a quasi-Gaussian intensity profile at the entrance of the corrugated output waveguide. The quasi-Gaussian profile is not a pure first order Gaussian function in intensity distribution, but has the approximate characteristics of a Gaussian intensity distribution which is created through the introduction of high order modes in the input waveguide 220 and mode conversion reflectors 240 and 250 of FIG. 2A. In one embodiment of the invention, the first mode conversion reflector is located within 0.25 to 4 wavelengths of the launch edge of the cylindrical input waveguide, such that RF beam reflected from the first mode conversion reflector has an amplitude profile with a substantially elliptical radiation pattern, and the shape of the second mode conversion reflector is selected to convert the incident elliptical radiation amplitude profile into a circularly symmetric free space wave with a beam waist which is narrow enough to efficiently couple into the input of a corrugated output waveguide which is optimized for propagation of an HE11 mode.

BRIEF DESCRIPTION OF THE DRAWINGS

FIG. 2A shows a cross section view of a gyrotron launch coupler.

FIG. 2B shows a cross section view of FIG. 2A.

FIG. 2C shows an input waveguide of FIG. 2A cut open and rolled flat.

FIG. 2D shows a cross section view of FIG. 2A.

FIG. 2D-1 shows a cross section view of FIG. 2A showing a different embodiment for a first mode changing reflector.

FIGS. 2G-1 and 2G-2 show the beam profiles through the y' and x' axis, respectively, of FIG. 2E.

FIG. 4A is a cross section view of the entrance of the input waveguide opposite the launch edge.

FIG. 4B is a cross section view of the input waveguide near the launch edge.

FIG. 4C is a cross section projection view of traveling wave energy in the gyrotron launcher.

FIG. 5 is a chart showing the power levels for co-propagating modes for a primary (m,n) mode.

DETAILED DESCRIPTION OF THE INVENTION

Figures 1A, 1B, 1C:
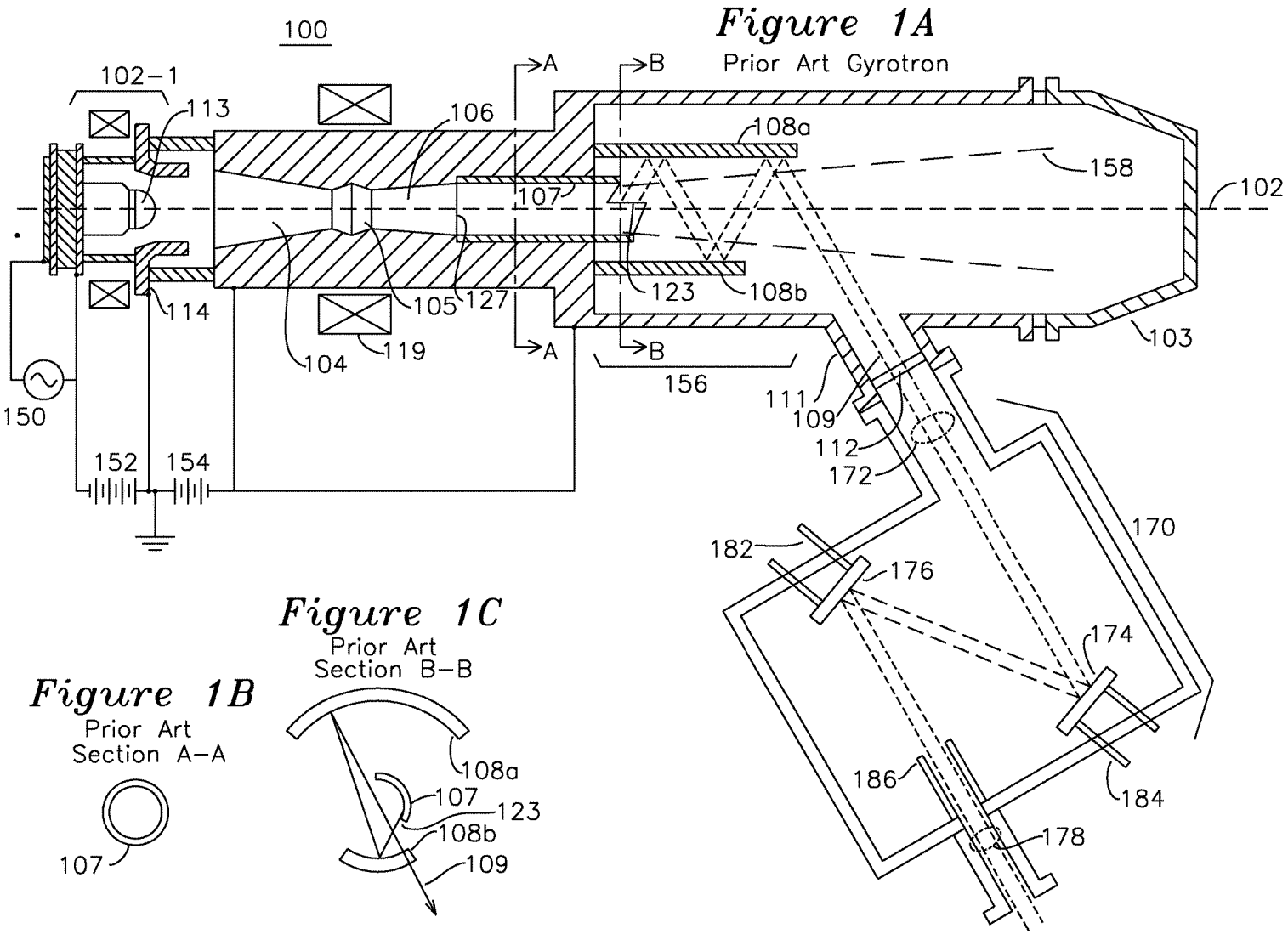
Figure 1C Prior Art
Figure 1B Prior Art
FIG. 1A shows a cross section view of a prior art gyrotron coupled to a mirror optical unit for generation of a HE11 mode.
FIG. 1B shows a cross section view of prior art FIG. 1A.
FIG. 1C shows a cross section view of prior art FIG. 1A.

The various figures and views of the invention identify each structure with a reference numeral which is understood to indicate the same structure in other figures or views. Additionally, certain figures include orthogonal x, y, and z axis indicators to clarify the plane of the particular view. FIG. 1A shows a prior art Gyrotron 100. An electron gun assembly 102-1 produces an annular electron beam that propagates about axis 102 through input beam tunnel 104 into a cylindrical cavity 105 where electron beam energy is converted to an RF mode with the RF energy propagating helically along the input waveguide. High power gyrotrons use transverse electric ($TE_{mn}$) modes with high radial (n) and azimuthal (m) mode numbers. The first subscript m indicates the number of full waves about the circumference of the waveguide, and the second subscript n indicates the number of half waves across the diameter of the waveguide. A typical mode example is $TE_{24,6}$, with this high order mode RF energy propagating helically along the inner surface of the input waveguide in a surface wave mode referred to as a whispering gallery (WG) mode. The RF energy propagates from the cavity 105 into a waveguide of increasing diameter 106 and into cylindrical waveguide 107 having entrance 127. Because whispering gallery modes cannot be easily transported in a waveguide or efficiently used by downstream devices, the whispering gallery mode is typically converted to a quasi-optical mode inside the gyrotron. This is accomplished by radiating the RF power from a step cut launch edge 123 in cylindrical input waveguide 107. The radiated wave energy propagates through free space to focusing mirrors 108*a* and 108*b*. Mirrors 108*a* and 108*b* modify the phase and amplitude distribution of the RF wave such that the beam passing through vacuum sealed aperture 112 of window support 111 is a Gaussian-shaped, quasi-optical, free space wave.

In one example embodiment, waveguide 107 has an inner surface which is modified to shape the waveguide whispering gallery mode such that the RF beam radiated from step cut launch edge 123 has reduced side lobes with increased power in the central lobe of the RF beam directed toward reflectors 108*a* and 108*b*. Such shaping is accomplished using surface field integral analysis and coupled with advanced optimization routines.

A disadvantage of the device 100 is that additional modifications of the free space output beam 109 are required to couple the RF power into a waveguide for transport to downstream devices, such as an antenna. This is accomplished with a device commonly referred to as a Mirror Optical Unit (MOU) 170, which is coupled to the output beam 109 of the gyrotron 100. The output beam 109 may travel through one or more diamond vacuum-sealed apertures 112, thereafter to phase shaping mirrors 174 and 176, which are fabricated from high thermal conductivity and high electrical conductivity metals such as copper, and which are profiled to shape the large cross section beam diameter (also known as beam waist in the art of free space wave propagation) of the free space Gaussian beam profile 172 to minimize reflections as the free space Gaussian wave transitions to HE11 mode at the waveguide entrance, and one of the objectives of the mirrors is to reduce the free space beam waist before delivery to the entrance of waveguide 186 where the RF beam 178 continues to propagate. Because the gyrotron 100 produces an RF beam with an output beam axis which relies on the angle relationship of many reflective surfaces including step cut launch edge 123, first reflector 108*b* and second reflector 108*a*, the axis of the beam output 109 may vary from device to device. To compensate for these geometric variations, MOU first reflector 174 and MOU second reflector 176 are usually separately adjustable about each mirror's orthogonal mirror axis, which allows adjustment of the beam angle delivered to waveguide 186, and waveguide 186 additionally has a 2-axis translation so that the beam may be centered in the waveguide. The various mirrors 174 and 176 have angle adjustments (184 and 182, respectively) and output waveguide 186 has a translation adjustment, such that adjusting each of these reflectors and waveguides results in significant setup time and cost, and the adjustment settings may change because of the long beam path and wide mirror spacing as a result of factors such as thermal expansion of structures along this path. A further disadvantage of the gyrotron 100 is that the output window 112 which couples energy out of the gyrotron 100 must be relatively large in diameter due to the radial extend of the Gaussian quasi-optical free wave mode which travels through window 112, which is fabricated using a chemically vapor deposited (CVD) diamond, which has a low RF absorption and high thermal conductivity, which are required for high power (1 MW and above) gyrotrons to prevent damage to the window from thermal energy absorbed from the high power beam. The large diameter Gaussian quasi-optical mode which propagates through window 112 results in a large diameter aperture compared to the reduced diameter of the output waveguide 186 after conversion to a HE11 mode. Additionally, the propagating RF energy leaving the gyrotron is directed through the spent electron beam 158 to collector 103, where undesirable interactions may occur. Also shown are cathode 113, heater power supply 150, modulated anode 114, modulated anode power supply 152, main power supply 154, and solenoidal magnetic field generator 119, all of which are well known in the art. FIG. 1A has cross section views A-A and B-B, shown in FIGS. 1B and 1C respectively, which shows section views of the structures previously described, including cylindrical waveguide 107, for additional clarity.

Figures 1, 2A, 2B, 2C, 2D:
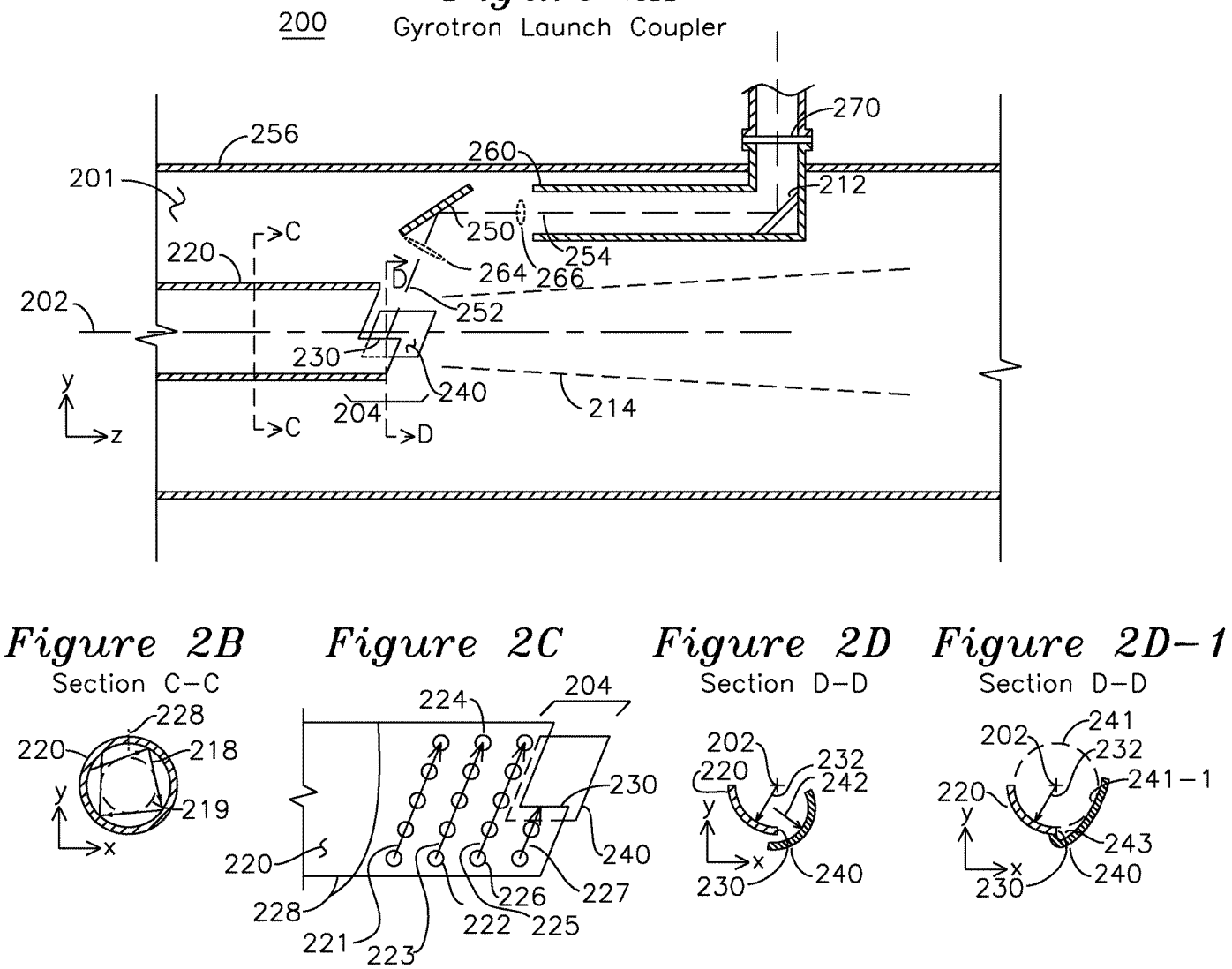

FIG. 2A shows an example embodiment of a gyrotron launch coupler 200 of the present invention which may be used to replace the cylindrical waveguide 107, upper mirror 108*a* and lower mirror 108*b* over axial extent 156 of FIG. 1A, and also the mirror optical unit 170 of FIG. 1A, such that a HE11 mode RF beam may be coupled into a corrugated waveguide such as 186 of FIG. 1A. Corrugated waveguides are well known in the art for transmission of HE11 mode wave energy, and an example corrugated waveguide 260 with axis 254 is shown in FIG. 2I, corresponding to the structures of FIG. 2A. Gyrotron enclosure 256 supports internal structures enclosed in vacuum chamber 201 isolated from external pressure by vacuum RF window 270. The gyrotron launch coupler 200 shown in FIG. 2A receives helically propagating WG mode guided RF energy in input waveguide 220, the RF energy launched via launch edge 230 into adjacent first mode conversion reflector 240, which produces an elongated or elliptical Gaussian beam 264 propagating in free space (with extents shown as beam plot 280 of FIG. 2E viewed perpendicular to the local beam axis 281), which is reflected by second mode conversion reflector 250, where the free space Gaussian mode wave reduces in beam diameter shown as beam 266 and with a beam extent perpendicular to beam axis 254 of FIG. 2A as shown in FIG. 2F about local beam axis 281, and having a beam diameter or beam waist 282, and becomes circularly symmetric about the propagation axis (281 of FIG. 2F and 254 of FIG. 2A) of the beam 266 of FIG. 2A. This free space Gaussian beam is then suitable for direct coupling to corrugated output waveguide 260 and RF mirror 212, which results in a greatly reduced beam diameter (beam waist energy extent) and associated diamond vacuum RF window 270 diameter compared to the beam waist energy extent and associated window 112 diameter of FIG. 1A. Spent electron extent 214 remains as shown in FIG. 1A. FIGS. 2D and 2D-1 show section D-D through FIG. 2A for two respective embodiments of the edge launcher.

In the launch coupler of FIG. 2A, RF energy conveyed in an electron beam (not shown) is propagated helically as a higher order transverse electric (whispering gallery) RF mode in cylindrical input waveguide 220. Cross section C-C of FIG. 2A shows cylindrical input waveguide 220 in FIG. 2B including a single "ray tracing" 218 which indicates the individual surface reflections of the quasi-optical helical RF beam 219, as is known in the art of WGM RF propagation. For clarity in understanding the invention, a "split line" 228 is shown in input waveguide 220 of FIG. 2B, and if the cylindrical input waveguide 220 were split on this line 228 and laid flat, the traveling whispering gallery mode (WGM) waves which propagate across this surface would travel through launch region 204 of FIG. 2A as shown in FIG. 2C, where the continuous helical wave propagation appears as individual linear propagation paths 221, 223, 225, 227 about split line 228. As is clear to those skilled in WGM propagation, a helically propagating wave inside waveguide 220 propagates with a fixed axial velocity, and accordingly, if waveguide 220 were longitudinally cut and unwrapped as shown in FIG. 2C, the single path of helical propagation becomes the continuous path shown as segments 221, 223, 225, 227. Accordingly, each of the propagation paths has associated whispering gallery mode radiation intensity contour patterns along the continuous line of propagation of path 221, path 223, path 225, and path 227, with the RF field along path 223 shown as contour 222 extending to contour 224, thereafter continuing along path 225 with contour 226, for a succession of wave features representing the surface RF energy intensity of adjacent RF nodes at an instant of time as the propagation paths 221, 223, 225, 227 lead to helical launch edge 230. A first mode conversion reflector 240 is positioned adjacent to helical launch edge 230, and, as shown in FIG. 2A, a second mode conversion reflector 250 is positioned in the propagation path centerline 252 axis as the second mode conversion reflector 250 reflects energy to corrugated waveguide 260 as HE11 mode energy along propagation path centerline 254. The positioning of first mode conversion reflector 240 in the range 0.25 wavelengths and 4 wavelengths from helical launch edge 230 is typical, as RF radiated from helical launch edge 230 immediately interacts with first mode conversion reflector 240, after which it is directed to second mode conversion reflector 250, usually with an elliptical or elongated radiation pattern with the radiation pattern long axis (shown as the launch axis x' in FIG. 2E) substantially parallel to the propagation paths 221, 223, 225, and 227 and the radiation pattern short axis (shown as axis y' in FIG. 2E) which is substantially parallel to the helical launch edge 230. Second mode conversion reflector 250 has a surface profile selected to reshape the aspect ratio of the incident RF beam from an elliptical or elongated radiation pattern to precisely match the circular electromagnetic field pattern of HE11 mode RF beam supported by corrugated waveguide 260 and having a beam waist which optimally couples the HE11 mode RF beam into the entrance of corrugated waveguide 260. The RF beam can be efficiently propagated through corrugated waveguide 260 and redirected as required by one or more miter bends 212 and through vacuum RF window 270, as shown in FIG. 2A.

Figure 2E:
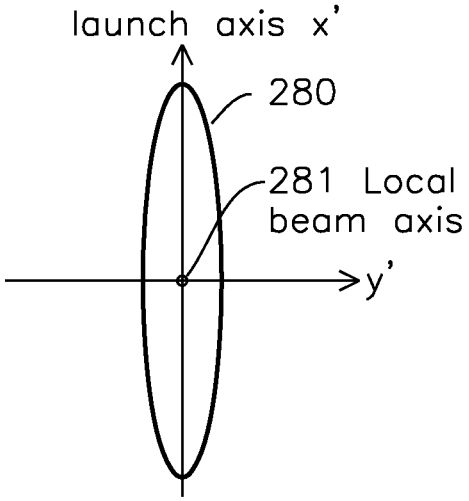
FIGS. 2E and 2F show cross section beam profile plots in a plane orthogonal to the RF beam.
Figure 2F:
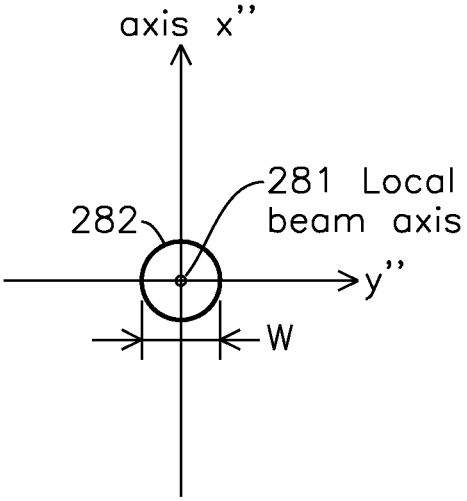
Figures 1, 2G:
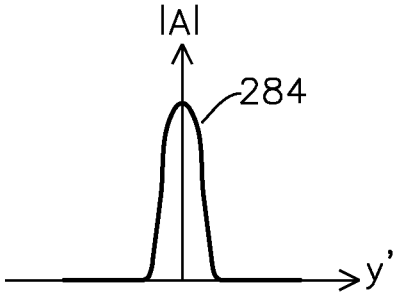
Figure 2H:
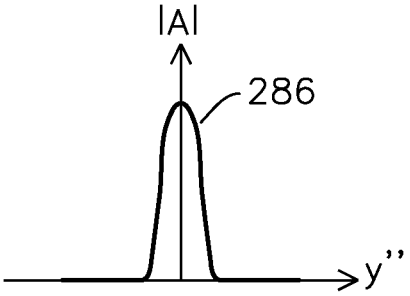
FIG. 2H shows the beam amplitude profile for plot 2F.
Figures 2, 2G:
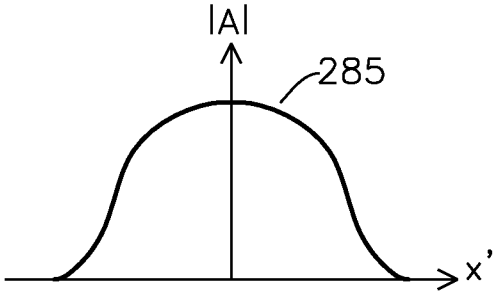
Figure 2I:
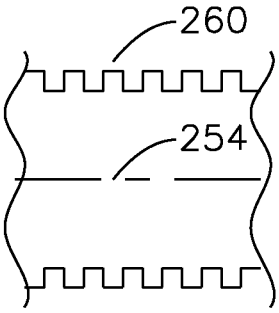
FIG. 2I shows a cross section diagram of a corrugated waveguide.

FIG. 2E shows an RF beam profile 280 in an x',y' plane perpendicular to the local beam axis 281 and in the region 264, as shown in FIG. 2A, between the first mode conversion reflector 240 and second mode conversion reflector 250, the beam profile 264 of FIG. 2A shown closer to the second mode conversion reflector 250. The beam profile 280 (shown in FIG. 2E) tends to be elongated or elliptical, and with an aspect ratio on the order of 5:1. FIG. 2G-1 shows the amplitude profile 284 of the RF beam 280 across the y' axis, and FIG. 2G-2 shows the amplitude profile 285 of the RF beam 280 (shown in FIG. 2E) across the x' axis, each of which tend to be a quasi-Gaussian function across their respective axis. The dependent axis of each of FIGS. 2G-1, 2G-2 and 2H are labeled |A| to indicate absolute value of amplitude for clarity in understanding the invention.

FIG. 2F shows the RF beam profile in the plane x",y" perpendicular to the RF beam axis at the output of the second mode converting reflector. The second mode conversion reflector 250 corrects for the incoming elliptical beam profile shown in FIG. 2E, and generates a substantially circularly symmetric radiation pattern 282 with a beam profile 286 as shown in FIG. 2H. The RF beam profile which exits second mode conversion reflector 250 tends to have a beam profile 282, or beam waist W, which has a minimum waist diameter, and the location of the beam waist minimum is the preferred location for the entry of the RF beam into corrugated waveguide 260.

Because of the reduced radial extent of the RF beam within the HE11 waveguide, vacuum RF window 270 shown in FIG. 2A can have a significantly smaller diameter than would be required for a free space quasi-optical Gaussian mode beam 109 of FIG. 1A. Moving the RF window to a region near the HE11 mode_waveguide allows the diameter of the RF window to reduce to the diameter of the MOU output waveguide 186. Additionally, since the gyrotron of FIG. 2A has greatly reduced path lengths between reflective surfaces and the structures are closely associated compared to the gyrotron of FIG. 1A, it is not necessary to perform the beam alignment associated with adjustable mirrors, as the HE11 mode beam can be directly coupled into output corrugated waveguide 260. This results in significant cost reduction through the reduced number of structures, reduced exit vacuum RF window 270 diameter, and elimination of the MOU 170 alignment requirements compared to the device of FIG. 1A. In one example of the invention shown in FIG. 2D-1, the cylindrical waveguide 220, launch edge 230, first mode conversion reflector 240, and second mode conversion reflector 250 of FIG. 2A are formed from a single homogeneous material such as copper, so there are no mechanical interfaces or joints to change the alignment.

In one example of the invention, the device operates at a frequency of 110 GHz, waveguide 220 has a radius 232 (of FIG. 2D) of 20.5 mm, and the first mode conversion reflector 240 has a circular cross section with a radius 242 (of FIG. 2D) less than 20.5 mm, and an axial extent approximately equal to the axial extent of the launch edge 230, which is computed from the wave number of the RF energy propagating in the WG mode. The included angle of the first mode conversion reflector 240 about its center of radius is approximately 90 degrees, or one quarter of the circular waveguide 220, although this can range from 30 degrees to 120 degrees. Second mode conversion reflector 250 has an angle with respect to the axis 202 which is selected to re-direct the RF energy propagating on axis 254 to be parallel to the axis 202 of FIG. 2A, although this angle can be selected based on the preferred exit angle for propagating RF energy coupling into the corrugated output waveguide 260.

Many example embodiments are possible for the surface shape of waveguide surface 220, first mode conversion reflector 240, and second mode conversion reflector 250. In one embodiment of the invention, the cylindrical waveguide 220, first mode conversion reflector 240, and second mode conversion reflector 250 have surface shapes and profiles which are optimized by using surface integral field analysis, including finite element analysis software coupled with advanced electro-magnetic field optimization software.

In another embodiment of the invention shown in FIG. 2D-1, the first mode conversion reflector 240 is shown with respect to launch edge 230, and the first mode conversion reflector 240 is integral with cylindrical waveguide (shown as dashed outline 241) and includes a discontinuous region 243 where first mode conversion reflector 240 has a surface which is generally radial and perpendicular in region 243 and also adjacent to launch edge 230. The first mode conversion reflector 240 has a region 241-1 which is optionally tangent to the projected diameter of input waveguide 241 (shown as dashed line), and in one embodiment of the invention, the first mode conversion reflector 240 includes active surfaces which are adjacent to launch edge 230 and which are within a quarter wavelength to 4 wavelengths of the WG RF propagating within input waveguide 241.

Internal to cylindrical waveguide 220 are a series of deformations that convert the mode incident from the gyrotron to a Gaussian like beam. In one example embodiment of the invention, cylindrical waveguide 220 has surface deformations which generate enhanced currents which provide a semi-Gaussian beam which is not circularly symmetric in radiation pattern, but one which has an intensity profile with an elliptical intensity cross section as previously described, and with an initially long axis parallel to the arc formed by a radial line which is perpendicular to the center axis 202 and swept along helical path 221, 223, 224, 227, shaped principally by first mode conversion reflector 240 of FIGS. 2A, 2C, and 2D. The long axis x' (parallel to path 223, 225, 227 of FIG. 2C) of the radiation pattern is focused by first mode conversion reflector 240 of FIGS. 2A, 2C, 2D, and 2D-1 such that the long axis x' extent reduces along path 252 of FIG. 2A and reaches a minimum extent at the entrance to the corrugated waveguide 260, optionally also shaped and focused for x' extent along the propagation path 252 by second mode conversion reflector 250. Second mode conversion reflector 250 may also provide surface shaping to reduce the beam extent in the short axis y' of the radiation pattern (parallel to launch edge 230) until it similarly reaches a minimum extent at the entrance to the corrugated waveguide, with the radiation at the entrance to the corrugated waveguide 260 preferably achieving a substantially circular cross section radiation pattern. The profiles of first mode conversion reflector 240 of FIGS. 2A, 2C, 2D, and 2D-1 and second mode conversion reflector 250 of FIG. 2A are selected to provide maximum coupling efficiency for the free space quasi-Gaussian RF energy propagating into the waveguide 260. The elliptical quasi-Gaussian output beam containing high order modes is thereby focused and shaped into a substantially circular cross section suitable for free-space coupling into the circular corrugated waveguide 260 which supports propagating HE11 mode RF energy, thereby minimizing coupling losses at the free-space wave to corrugated waveguide interface. For the purposes of this invention, "substantially circular" may be defined to be a shape which has a short axis dimension which is within 20% of a long axis dimension. For example, if the long axis of radiation pattern 282 of FIG. 2F is 20 mm and the short axis of this radiation pattern is in the range 16 mm to 20 mm, this radiation pattern may be considered "substantially circular".

In another example embodiment, the first reflector and mode conversion reflector 240 are integrated into the circular waveguide 220 having launch edge 230 to directly generate a circular RF beam cross section from the launch edge 230 onto RF beam propagation path 252.

Second mode conversion reflector 250 may be placed within the inner circumference of the tube envelope 256 to match the beam waist radiated from the launcher to the HE11 mode in the corrugated guide. This reflector 250 can also be used to tilt the output beam angle to be parallel to the tube axis 202.

In one embodiment of the invention, the cylindrical waveguide 220 has internal depressions on the inner waveguide surface which maximize the generation of quasi-Gaussian mode free space waves. The internal depressions on the inner waveguide cause the generation of "high order TE modes", which is defined in the present invention as any TE mode with an azimuthal mode greater than 15, such that for TEmn, m>15. In another embodiment of the invention, the first mode conversion reflector such as 240 provides a surface with an azimuthal radius of curvature which is less than the radius of curvature of the central waveguide 220 to reduce the transverse extent of the coupled RF energy from launch edge 230.

Figure 3A:
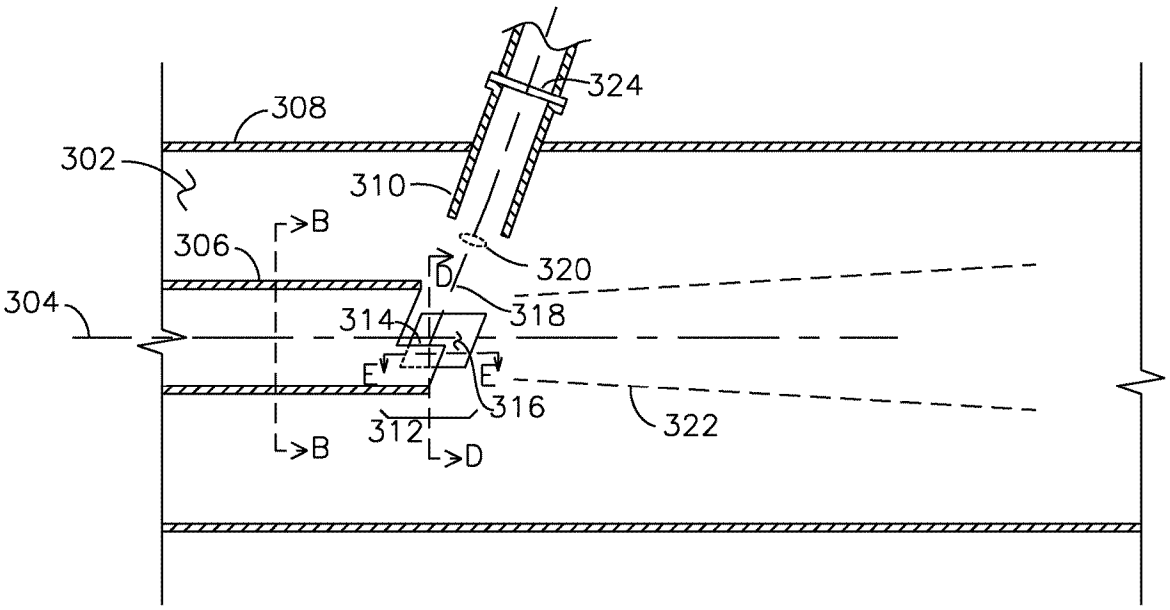
FIG. 3A shows a cross section view of a gyrotron with a single beam shaping reflector.
Figure 3C:
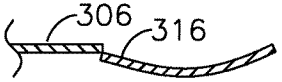
FIGS. 3B and 3C show section views D-D and E-E, respectively, of the beam shaping reflector of FIG. 3A.
Figure 3B:
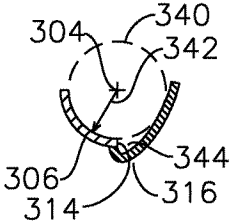

FIG. 3A, which may be viewed in combination with section D-D shown in FIG. 3B and section E-E shown in FIG. 3C, shows an embodiment 300 of the invention having a single dual purpose reflector 316 where the cylindrical waveguide 306 and launch edge 314 provide RF energy to a dual purpose reflector 316 which is similarly spaced (as in the structure of FIG. 2A) between a quarter wavelength and four wavelengths from launch edge 314, and which provides beam focusing and mode conversion to generate a circularly symmetric radiation pattern 320 on the RF beam propagation axis 318 and at the entrance to the corrugated waveguide 310. FIG. 3A also shows the spent electron beam 322 which, as in FIG. 2A, is minimally interacting with the free space propagating RF energy (in contrast with FIG. 1A where the propagating RF energy traverses through the spent RF beam 158 multiple times), enclosure 308 with evacuated chamber 302, central axis 304, launch region 312, and vacuum RF window 324 for preserving the vacuum of the gyrotron 300. FIG. 3A section C-C is identical to the previously described section C-C of FIG. 2B, and FIG. 3A section D-D is shown in FIG. 3B, where the waveguide 306 is formed into a launch edge 314 which have surfaces that are separated by gap 344 to nearby dual-purpose reflector 316, which performs the corrections described for mode conversion reflectors 240 and 250 of FIG. 2A, which results in a symmetric minimum waist beam of the free space RF which is provided at the entrance corrugated waveguide 310, which efficiently accepts the free space RF energy and transports HE11 mode through the corrugated waveguides and through RF transparent vacuum RF window 324. The additional axial focusing of dual purpose reflector 316 may be seen with the edge relationship to reflector 306 in FIG. 3C showing section E-E of FIG. 3A. Additionally, radius 342 and reference circle 340 of FIG. 3B identify analogous respective elements radius 232 and with reference circle 241 which indicates in dashed line reference the extent of input waveguide 220 shown in FIG. 2D-1.

The coupling efficiencies of the free space quasi-Gaussian RF coupling into the entrance of the corrugated waveguide, as shown in FIGS. 2A and 3A, provides for very efficient coupling and minimal reflection loss. The coupling efficiency into the corrugated waveguide for the devices of FIGS. 2A and 3A exceeds 95%, and is typically 98% or more.

Because of the close proximity of the components of the invention, as in FIG. 2A, any of the structures of FIG. 3A may be formed as a single unit, including any subset or set of: waveguide 306, launch edge 314, dual purpose reflector 316, and a support (not shown) for the corrugated waveguide 310. The fabrication of these components from a homogeneous slab of material such as copper can eliminate the need for mechanical adjustments of the prior art, and can also include corrective structures which minimize or eliminate mechanical deformations caused by thermal gradients in the gyrotron coupling structures.

Two important figures of merit for the gyrotron launcher of FIGS. 2A and 3A are coupling efficiency, measured by the fraction of RF energy injected into waveguide section 220 which is coupled into the HE11 waveguide 260 of FIG. 2A and waveguide 310 of FIG. 3A, and mode purity, which is the fraction of desired mode power compared to sum of the power in all modes being propagated. In prior art gyrotrons such as the example shown in FIG. 1A, typical mode purity is less than 90% and the coupling efficiency is less than 90% at the output waveguide section 178. For the construction of FIG. 2A or 3A, the coupling efficiency approaches 97-98% and the mode purity also approaches 97-98%. With regard to coupling efficiency on a 1 MW gyrotron, a change in coupling efficiency from 90% to 98% corresponds to a change from 100 KW power dissipation to 20 KW power dissipation, respectively, or a factor of 5 reduction in dissipated power.

Without modification of the interior surface of the whispering gallery mode waveguide 220, a wide range of high order RF modes will naturally propagate in waveguide 220. In the present invention, a series of dimples and/or grooves are provided which provide preferential coupling for selected particular modes. This is done by taking advantage of the "beat wavelength" which results from one high order mode mixing with another. The beat wavelength is determined by the pattern of constructive and destructive interference, which are many wavelengths long in the direction of propagation. The beat wavelengths are the result of the constituent RF waves which form the beat wavelength of the conveyed mode each propagating with a different phase velocity.

In the selection of the dimples and/or grooves on the inner surface of waveguide 220, many different high level modes can be selected for propagation. For a particular selected propagating mode, the table of FIG. 5 identifies the particular modes which are the subject of the surface features of the WG waveguide 220, first mode conversion reflector 240, and second mode conversion reflector 250 of FIG. 2A (or alternatively the single dual-purpose reflector 316 of FIG. 3A). The selection of surface waveguide features for these structures is done in combination to optimize for a Gaussian-like phase front $TEM_{00}$ mode at the entrance of the HE11 mode corrugated waveguide 260 of FIG. 2A or corrugated waveguide 310 of FIG. 3A. This Gaussian-like beam couples efficiently to the HE11 mode in the corrugated waveguide 260 or corrugated waveguide 310. $TEM_{00}$ is the well-known "Transverse Electric Mode", meaning the electric field is in the transverse plane (perpendicular to the axis of propagation). As was described earlier for TE mode RF energy, the first subscript is the radial mode number indicating the number of radial full waves about the circumference of the waveguide, and the second subscript is the azimuthal mode number, indicating the number of half waves across the diameter of the waveguide. FIG. 5 lists the co-propagating modes and power levels for a particular (m,n) primary mode (i.e. Quasi Optical mode mixing table). For example, for the earlier example of $TE_{24,6}$ optimization, the beat wavelengths listed in FIG. 5 would be $TE_{21,7}$, $TE_{27,5}$, $TE_{25,6}$, $TE_{23,6}$, $TE_{22,7}$, $TE_{20,7}$, $TE_{28,5}$, and $TE_{26,5}$ with each mode carrying the percentage of total power as indicated. In general, for a WG mode of $TE_{mn}$ RF energy introduced into the circular waveguide, the WGM surface deformations would be selected to include support for at least one of (reading across the rows of FIG. 5) $TE_{m-2,n+1}$ (1/36 power); $TE_{m+1,n}$ (1/9 power); $TE_{m+4,n-1}$ (1/36 power); $TE_{m-3,n+1}$ (1/9 power); $TE_{m,n}$ (4/9 power); $TE_{m+3,n-1}$ (1/9 power); $TE_{m-4,n+1}$ (1/36 power); $TE_{m-1,n}$ (1/9 power); and $TE_{m-2,n-1}$ (1/36 power).

The inner surface profile of waveguide 220 changes over the axial extent of the waveguide to provide a boundary condition which encourages the formation of particular modes based on the beat wavelengths for a particular primary mode, as shown in FIG. 5 which shows the modes which co-propagate with a particular (m,n) primary mode, where m is the azimuthal mode and n is the axial mode. The whispering gallery mode waveguide 220 inner surface is initially substantially cylindrical at the start of the waveguide as shown in FIG. 4A. Along an axial 202 extent of the waveguide 220, the inner surface profile changes gradually from a cylindrical inner surface to an inner surface defined by:

$$R(\phi,z)=R_0+a(z)\sin(N\pi\phi+m(z))$$

where:

$R_0$ is the nominal radial distance from the axis to the inner surface of the waveguide, as shown in FIG. 4A.

$R(\phi,z)$ is the swept inner radius of the waveguide 220;

a(z) is the dimple amplitude of the azimuthal variation of the inner surface of waveguide 220 with respect to the swept angle $\phi$;

N is the number of variations in a rotation through $\phi$ (N=5 in FIG. 4B);

m(z) is a linear term varying with z which provides an "azimuthal twist" to the dimple pattern shown in the cross section view of FIG. 4B, to preserve the sinusoidal variation and period experienced by a helically traveling wave through the extent as view at the end of waveguide 220 as shown in the cross section FIG. 4B, showing a simplified view of the inner surface of the waveguide. The primary and co-propagating high order modes propagate in a series of reflections helically down the whispering gallery mode waveguide 220, as previously described, and the pitch of the succession of dimples 404*a*, 404*b*, and 404*c* is chosen with a length of the beat wavelength of the mixture of primary and co-propagating high order modes. The depth of the dimples may vary axially down the waveguide 220 as the reinforcement of selected modes occurs. In addition to the sinusoidal azimuthal variation described in the equation above, an axial sinusoidal variation in the surface profile is also present, which generates a dimpled surface with local regions of maxima and minima, rather than continuous axial grooves. This complex waveguide inner surface contour provides the waveguide boundary necessary to couple the co-propagating high order modes of the table of FIG. 5 with the initial particular (m,n) primary mode. Accordingly, the cross section of FIG. 4B is not intended to indicate that the dimples 404*a*, 404*b*, 404*c*, and others are of fixed rotational position, or of fixed depth. A series of cross section views along section line C-C such as FIG. 4A would typically show a rotation clockwise or counterclockwise of the dimple features in successive axial positions along axis 202 as shown in FIGS. 4A-4C (representing the m(z) term in the equation above, and the depth of the dimple or groove features 404*a*, 404*b*, 404*c* with respect to the center axis 202 may increase or decrease, since the wave propagation is helical and the spacing from dimple to dimple is based on the beat wavelength. FIG. 4C shows the effect of the superposition of a plurality of propagating waves in a waveguide where N=5.

FIG. 4B also shows the dimple features 404*a*, 404*b*, 404*c* of the whispering gallery mode waveguide 220 providing a focusing and guiding function. In the case where the beam is propagating helically in a clockwise direction in the view of FIG. 4B, two reflected segments are shown with the preceding and successive segments not shown for clarity. As a propagating helical wave, it is understood that RF beam segments 410, and 416, and associated dimple features 404*a*, 404*b*, and 404*c* are at different axial positions, but are shown in the simplified projection view of FIG. 4B for clarity. Each interaction of the RF beam with features 404*a*, 404*b*, and 404*c* serves to focus and guide the beam to the elongate radiation pattern previously described for FIG. 2E. Additionally, the surface dimple shapes and positions are selected to provide a repeated focusing 402 of the beam, as can be seen with beam 410 reducing to a narrow diameter 412 and subsequently expanding as shown in region 414. This successive focusing and guiding occurs at beam 416 after reflection at dimple 404*b*, and in the beam reflected by dimple 404*c*. This focus progression continues until the propagating RF beam is launched as quasi-optical RF energy at launch edge 230 of FIG. 2A. The mode conversion reflectors after launch (240 and 250 of FIG. 2A and 316 of FIG. 3A) have a first order focusing which reshapes the beam profile as was described for FIGS. 2E, 2F, 2G-1, 2G-2 and 2H. This first order correction provides a minimum beam waist diameter the entrance 266 of corrugated waveguide 260 of FIG. 2A or entrance 320 of corrugated waveguide 310 of FIG. 3A. The surface of the mode conversion reflectors after launch also have a second order phase correction through the use of minor surface deformations (which are less than a wavelength in depth) which provides a second order phase correction to provide a modified quasi-Gaussian phase front $TEM_{00}$ at the corrugated waveguide entrance to maximize coupling to the HE11 mode in the waveguide 260.

In this manner, a wide variety of whispering gallery mode waveguide surface profiles and mode conversion reflectors can provide very efficient coupling and high mode purity in a gyrotron using three criteria in combination, as follows.

The first criteria is selection of a primary mode and a particular set of high order co-propagating modes (such as from FIG. 5) for propagation through the whispering gallery mode waveguide 220, which is provided by the surface dimples and features of the waveguide 220. In one embodiment of the invention, the surface dimples have a beat period separation which is greater than a wavelength in the direction of RF propagation.

The second criteria is the generation of a minimum RF beam diameter with a Gaussian-like profile at the entrance of the corrugated waveguide, which is provided by the geometric shape of the focusing mode conversion reflectors which the free space quasi-optical RF beam encounters after the launch edge of the WG waveguide.

The third criteria is generation of substantially uniform phase at the Gaussian beam phase front occurring at substantially the same extent in the beam axis as the minimum beam diameter at the corrugated waveguide entrance of the second criteria, and this third criteria is met through the minor surface deformations on the focusing mode conversion reflectors which perform these phase corrections, the minor surface deformations being less than a wavelength of the propagating RF energy which is reflected from the focusing reflectors.

The novel result of coupling directly into a corrugated waveguide inside the gyrotron cavity is based on the application of the above three criteria.

The gyrotron launcher of the present invention thereby comprises a whispering gallery mode waveguide with a step-cut launcher and one or more mode conversion reflectors, where the whispering gallery mode waveguide provides the formation of a primary (m,n) mode and the carried modes listed in the table of FIG. 5 are used to form beat wavelengths which are used to select the waveguide inner surface profile, the beat wavelength relationships between the primary (m,n) mode and co-propagating modes of FIG. 5 determining the inner surface profile on the whispering gallery mode waveguide, the one or more mode conversion reflectors having minor phase corrections to provide a Gaussian-like beam with minimum waist diameter at the entrance of the corrugated waveguide, which entrance is located inside the gyrotron evacuated chamber.

Accordingly, many different variations of the illustrated embodiments which rely on different high order modes may be used which operate according to the three criteria described above. The invention is best understood not by the particular examples given for understanding of the invention, but by the claims which follow.

I claim:

1. A whispering gallery mode (WGM) coupler comprising:

a corrugated waveguide having an entrance;

a cylindrical waveguide for propagation of RF energy, the cylindrical waveguide having a sequence of deformations on an inner surface, each said deformation causing a focusing and guiding of incident RF energy to a subsequent deformation of said sequence of deformations;

said cylindrical waveguide having a launch edge for directing RF energy in a quasi-optical mode to a mode conversion reflector;

said mode conversion reflector having a first order surface profile for converting said quasi-optical mode RF energy into a circularly symmetric RF beam having a minimum diameter at the entrance of said corrugated waveguide;

said mode conversion reflector also having a second order surface profile for providing a substantially uniform phase front of said circularly symmetric RF beam at said entrance of said corrugated waveguide.

2. The WGM coupler of claim 1 where said RF beam at the entrance of said corrugated waveguide propagates in said corrugated waveguide as HE11 mode RF energy, and said corrugated waveguide includes a mirror for changing the direction of said HE11 mode RF energy propagating in said corrugated waveguide.

3. The WGM coupler of claim 1 where said mode conversion reflector comprises a first reflector receiving said RF energy from said launch edge and forming an RF beam with an elongate cross section, said RF beam with the elongate cross section subsequently coupled to a second reflector which generates said circularly symmetric beam at the entrance of said corrugated waveguide.

4. The WGM coupler of claim 3 where said second reflector converts said elongate cross-section RF beam into said circularly symmetric beam.

5. The WGM coupler of claim 1 where said mode conversion reflector includes surface deformations which cause said circularly symmetric RF beam to have said substantially uniform phase front at said entrance of said corrugated waveguide.

6. The WGM coupler of claim 1 where said cylindrical waveguide sequence of deformations supports at least two different WGM propagation modes in said cylindrical waveguide, thereby providing a fractional bandwidth of at least 40%.

7. The WGM coupler of claim 6 where at least one of said at least two different propagation modes includes a $TE_{24,6}$ mode.

8. The WGM coupler of claim 7 where said at least two different propagation modes also includes at least one mode selected from $TE_{21,7}$, $TE_{27,5}$, $TE_{24,7}$, and $TE_{24,5}$.

9. The WGM coupler of claim 1 where said mode conversion reflector comprises a first reflector adjacent to said launch edge.

10. The WGM coupler of claim 9 where said launch edge and said reflector are a common structure.

11. A Whispering Gallery Mode (WGM) coupler for a gyrotron comprising:

a WGM waveguide receiving high order mode radio frequency (RF) energy, the WGM waveguide having a succession of internal deformations for repeatedly focusing and guiding said high order mode RF energy which propagates therein and delivering said RF energy to a launch edge of said WGM waveguide as quasi-optical RF energy;

a reflector receiving said quasi-optical RF energy from said launch edge;

a corrugated waveguide receiving substantially quasi-optical RF energy reflected from said reflector;

said WGM waveguide operative on at least one high order mode of said propagating RF energy;

said reflector also having a first order correction for focusing said substantially quasi-optical RF energy into a substantially circular beam at the entrance of said corrugated waveguide;

said reflector having a second order correction for phase correcting said substantially quasi-optical RF energy to have a substantially uniform phase at the entrance of said corrugated waveguide.

12. The WGM coupler of claim 11 where said substantially uniform phase is a $TEM_{00}$ mode RF beam.

13. A whispering gallery mode (WGM) coupler comprising:

a cylindrical waveguide having a sequence of deformations for focusing and guiding incident RF energy into one or more high order modes, said sequence of deformations selected to form beat wavelengths of said high order modes, said deformations causing a focusing and guiding of said incident RF energy to a launch edge, thereby forming a quasi-optical RF beam having a plurality of high order modes;

a corrugated waveguide having an entrance;

a phase transforming reflector receiving said quasi-optical RF beam having said plurality of high order modes, said phase transforming reflector forming a circularly symmetric RF beam having a substantially uniform phase at said entrance of said corrugated waveguide.

14. The WGM coupler of claim 13 where for a particular high order mode $TE_{m,n}$, said deformations causing said focusing and guiding of said incident RF energy are selected to include at least one of: $TE_{m-2,n+1}$, $TE_{m+1,n}$, $TE_{m+4,n-1}$, $TE_{m-3,n+1}$, $TE_{m+3,n-1}$, $TE_{m-4,n+1}$, $TE_{m-1,n}$, and $TE_{m-2,n-1}$ RF modes.

15. The WGM coupler of claim 13 where said phase transforming reflector has deformations which are selected to form said circularly symmetric RF beam and which has a $TEM_{00}$ mode at said corrugated waveguide entrance.

16. The WGM coupler of claim 13 where said phase transforming reflector comprises a first reflector transforming said quasi-optical RF beam into an RF beam having an elliptical RF cross-section and a second reflector transforming said RF beam having said elliptical RF cross section into said circularly symmetric RF beam having said substantially uniform phase at said entrance of said corrugated waveguide.

17. The WGM coupler of claim 16 where said first reflector is located within 0.25 wavelengths to 4 wavelengths from said launch edge.

18. The WGM coupler of claim 16 where said second reflector corrects for said elliptical RF cross section and forms said circularly symmetric RF beam having a minimum beam waist at the entrance to said corrugated waveguide.

19. The WGM coupler of claim 13 where said corrugated waveguide supports HE11 mode RF energy and has a window aperture for transmission of said circular symmetric RF beam provided at said entrance.

* * * * *